US006203290B1

(12) United States Patent
Tamura et al.

(10) Patent No.: US 6,203,290 B1
(45) Date of Patent: Mar. 20, 2001

(54) CLOSED-TYPED ELECTRICALLY-DRIVEN COMPRESSOR

(75) Inventors: Kazumi Tamura; Koichi Sekiguchi, both of Tochigi-ken; Atsushi Shimada, Tochigi; Toshiyuki Terai, Ibaraki-ken; Tetsuya Tadokoro, Sano, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/159,093

(22) Filed: Sep. 23, 1998

(30) Foreign Application Priority Data

Sep. 24, 1997 (JP) ..... 9-258003

(51) Int. Cl.[7] ..... F04B 39/12
(52) U.S. Cl. ..... 417/410.3; 415/182.1
(58) Field of Search ..... 417/410.1, 410.3, 417/410.4, 410.5, 902; 415/182.1

(56) References Cited

U.S. PATENT DOCUMENTS 4,730,997 * 3/1988 Tamura et al. ..... 418/55
4,840,547 * 6/1989 Fry ..... 417/422

OTHER PUBLICATIONS

Japanese Patent Examined Publication No. 3–57318.

Japanese Utility Model Unexamined Publication No. 64–1495.

* cited by examiner

*Primary Examiner*—Henry C. Yuen
*Assistant Examiner*—Arnold Castro
(74) *Attorney, Agent, or Firm*—Antonelli, Terry, Stout & Kraus, LLP

(57) ABSTRACT

A closed-type electrically-driven compressor comprising a compressing mechanism portion and an electric motor portion driving the compressing mechanism portion within a closed container, which is formed to be substantially cylindrical, and a terminal fitted into a hole formed in a cover body of the closed container and welded to the cover body, and wherein a mount portion and vicinities of the terminal on the cover body of the closed container are formed into a convex-shaped portion which is protuberant from a peripheral flat portion of the cover body.

3 Claims, 4 Drawing Sheets

CLOSED-TYPED ELECTRICALLY-DRIVEN COMPRESSOR

BACKGROUND OF THE INVENTION

1. Field of the Invention

The present invention relates to a closed-type electrically-driven compressor, and more particularly to a closed-type electrically-driven compressor employing a high pressure chamber system used for refrigerators and air conditioners.

2. Description of the Prior Art

A closed-type electrically-driven compressor employing a conventional high pressure chamber system will be described below with reference to FIGS. 4 to 6.

FIG. 4 is a cross sectional view showing a structure of a closed-type electrically-driven compressor of the prior art, FIG. 5 is a cross sectional view of a main portion of a cylindrical body and a cover body in a general closed-type electrically-driven compressor popular of the prior art and FIG. 6 is a cross sectional view showing an essential part of the prior closed-type electrically-driven compressor with its cover body deformed due to an internal pressure.

The closed-type electrically-driven compressor shown in FIG. 4 is structured such that a compressing mechanism portion 10 and an electric motor portion 20 driving the compressing mechanism portion are received within a cylindrical body 30, which constitutes a main body of a closed container, a refrigerant sucked from a refrigerant suction pipe 40 is compressed in the compressing mechanism portion 10 and then discharged into the cylindrical body 30 (the closed container) from a refrigerant discharge port 11 provided in the compressing mechanism portion 10 to be filled in the cylindrical body 30 and then discharged from a discharge pipe 41. The closed container is constructed (a high pressure chamber system) such that internal pressures are caused by the refrigerant to act thereon in operation.

The cylindrical body 30 shown in FIG. 4 is substantially formed in a cylindrical shape, and is provided with a cover body 31 which sealing the cylindrical body 30. The cover body 31 is formed by press work of a steel sheet. Further, a terminal 50 is fitted in a hole formed in the cover body 31 to be welded to the cover body 31. Since the refrigerant exerts internal pressures on the cover body 31 during operation as mentioned above, it is necessary to ensure a pressure resisting strength against a high pressure in operation. As a countermeasure thereof, it is generally known as an ideal configuration to form the cover body substantially in a spherical shape.

However, such spherical-shaped cover body increases a length of the closed container of the compressor to increase a space in the refrigerant equipment, into which the compressor is mounted. Further, in the case of mounting on the cover body the terminal 50 for supplying electricity to the electric motor portion 20, which drives the compressing mechanism portion 10, and the pipes 40 and 41 for circulating the refrigerant and the like, there are caused problems with espect to weldability, assembling quality, formability of the cover body itself and the like. Then, as shown in FIG. 5, the cover body 31 employs a substantially flat configuration to improve productivity.

A structure of the closed container having the substantially flat cover body and shown in FIG. 5 will be described hereinbelow.

The reference numeral 30 denotes a cylindrical body which constitutes a main body of the closed container, and the compressing mechanism portion 10 and the electric motor portion 20 are received within the cylindrical body 30, which is not shown in the drawing. The reference numeral 31 denotes a cover body, which is fixed to the cylindrical body 30 through a welded portion 32 to form a container of the closed-type compressor. The reference numeral 50 denotes a terminal, which is fixed to a hole formed on an upper surface of the cover body 31 through a welded portion 51.

Further, a terminal pin 52 for supplying electricity to the electric motor is provided inside and outside the terminal 50. The reference numeral 40 denotes a refrigerant suction pipe, which is fixed to the cover body 31 of the cylindrical body 30 through a welded portion 41. The reference numeral 60 denotes a pin for securing of a cover covering the terminal 50, which is fixed to the cover body 31 of the cylindrical body 30 through a welded portion 61.

Incidentally, Japanese Utility Model Publication Nos. 64-1495 and 3-57318 disclose a prior art with respect to the container of prior closed-type compressors.

Such prior closed-type compressors present the following problems in the structure of their cover.

In recent years, it has been necessary to employ an alternative refrigerant in refrigeration and air conditioning equipments for the purpose of preventing an ozone layer from being broken, and the substitutive refrigerant includes a refrigerant, typified by refrigerant R-410A, which involves a pressure about 1.5 times that of the conventional refrigerant under the same temperature condition.

When such refrigerant involving a high pressure is used to operate the compressor having the conventional closed container as shown in FIG. 5, internal pressures acting on the cover body 31 tend to deform a substantially flat portion into a spherical shape as shown in FIG. 6. Accordingly, since a central portion of the cover body 31 is tensioned in a radial direction, it is made thin in thickness. Further, since a force tending to strip off the welded portion 51 between the cover body 31 and the terminal 50 or the welded portion 41 between the cover body 31 and the refrigerant suction pipe 40 is increased more than the conventional manner, problems of leakage of the refrigerant are liable to occur.

Then, increasing a thickness of the cover body may be adopted as means for solving the problem, investigation reveals that the thickness of the cover body 31 should be increased to about 2.5 times the conventional thickness in order to stand an increase of the pressure amounting to about 1.5 times that with the conventional refrigerant. Therefore, there are caused problems that the cover body can not be easily formed by press work of a steel sheet and it is increased in weight.

SUMMARY OF THE INVENTION

The present invention solves the problems the in prior art mentioned above, and has its object to provide a closed-type electrically-driven compressor using an alternative refrigerant, typified by a refrigerant R-410A, in which an increase in a thickness of a cover body is limited as much as possible, a pressure resisting quality is ensured, and an assembling quality such as weldability between the cover body and a terminal and between the cover body and a refrigerant circulating pipe is improved.

In order to achieve the object mentioned above, in an aspect, the present invention provides a closed-type electrically-driven compressor comprising a compressing mechanism portion and an electric motor portion driving the compressing mechanism portion within a closed container, which is formed to be substantially cylindrical, and a terminal fitted into a hole formed in a cover body of the closed container and welded to the cover body, and wherein a central portion and vicinities of the cover body on the closed container are formed in either of concave and convex shapes. In the course of development of the invention, a center of a cover body of a closed container, more specifically, a portion from a terminal toward the center of the cover body, on which a drawn portion (equivalent to a rib) was tested, but an effect of relaxing stress concentration was of little avail. In this respect, it was confirmed that when such drawn portion was extended from the center of the cover body toward vicinities thereof, some effect of relaxing stress concentration was of little avail.

Further, in order to achieve the object mentioned above, in another aspect, the present invention provides a closed-type electrically-driven compressor comprising a compressing mechanism portion and an electric motor portion driving the compressing mechanism portion within a closed container, which is formed to be substantially cylindrical, and a terminal fitted into a hole formed in a cover body of the closed container and welded to the cover body, and wherein a mount portion and vicinities of the terminal on the cover body of the closed container are formed to be either concave or convex from a peripheral portion of the cover body.

Concretely, the invention provides a closed-type electrically-driven compressor comprising a compressing mechanism portion and an electric motor portion driving the compressing mechanism portion within a closed container, which is formed to be substantially cylindrical, a terminal fitted into a hole formed in a cover body of the closed container and welded to the cover body, and a drawn-shaped portion formed in a mount portion of the terminal on the cover body on the closed container and having a flat portion which is substantially concentric about the mount portion of the terminal to be protuberant above and separated from a peripheral flat portion of the cover.

Still further, in order to achieve the object mentioned above, in further aspect, the present invention provides a closed-type electrically-driven compressor comprising a compressing mechanism portion and an electric motor portion driving the compressing mechanism portion within a closed container, which is formed to be substantially cylindrical, and a terminal fitted into a hole formed in a cover body of the closed container and welded to the cover body, and wherein a mount portion and vicinities of the terminal on the cover body of the closed container are formed to be either concave or convex from a peripheral portion of the cover body and wherein a portion radially of the terminal is formed in either of concave and convex shapes.

Concretely, the invention provides a closed-type electrically-driven compressor comprising a compressing mechanism portion and an electric motor portion driving the compressing mechanism portion within a closed container, which is formed to be substantially cylindrical, and a terminal fitted into a hole formed in a cover body of the closed container and welded to the cover body, a drawn-shaped portion formed in concentric manner in a mount portion of the terminal and around a pin, for mounting a cover of the terminal, on the cover body on the closed container and having a flat portion which is protuberant above and separated from a peripheral flat portion of the cover, and at least one drawn-shaped portion formed radially of the terminal and a flat portion which is protuberant above and separated from the peripheral flat portion of the cover.

More specifically, the flat portion of the drawn-shaped portion formed in concentric manner in the mount portion of the terminal and around a pin, for mounting the cover of the terminal, on the cover body on the closed container and the flat portion of the drawn-shaped portion formed radially of the terminal are the same in height of protuberance, and wherein stepped portions associated with the respective flat portions are smoothly formed.

DESCRIPTION OF THE PREFERRED EMBODIMENTS

A representative embodiment in accordance with the present invention will be described hereinbelow with reference to FIGS. 1 to 3. A structure of a main body of a closed-type electrically-driven compressor in accordance with the embodiments is similar to that of the general structure shown in FIG. 4.

Figure 4:
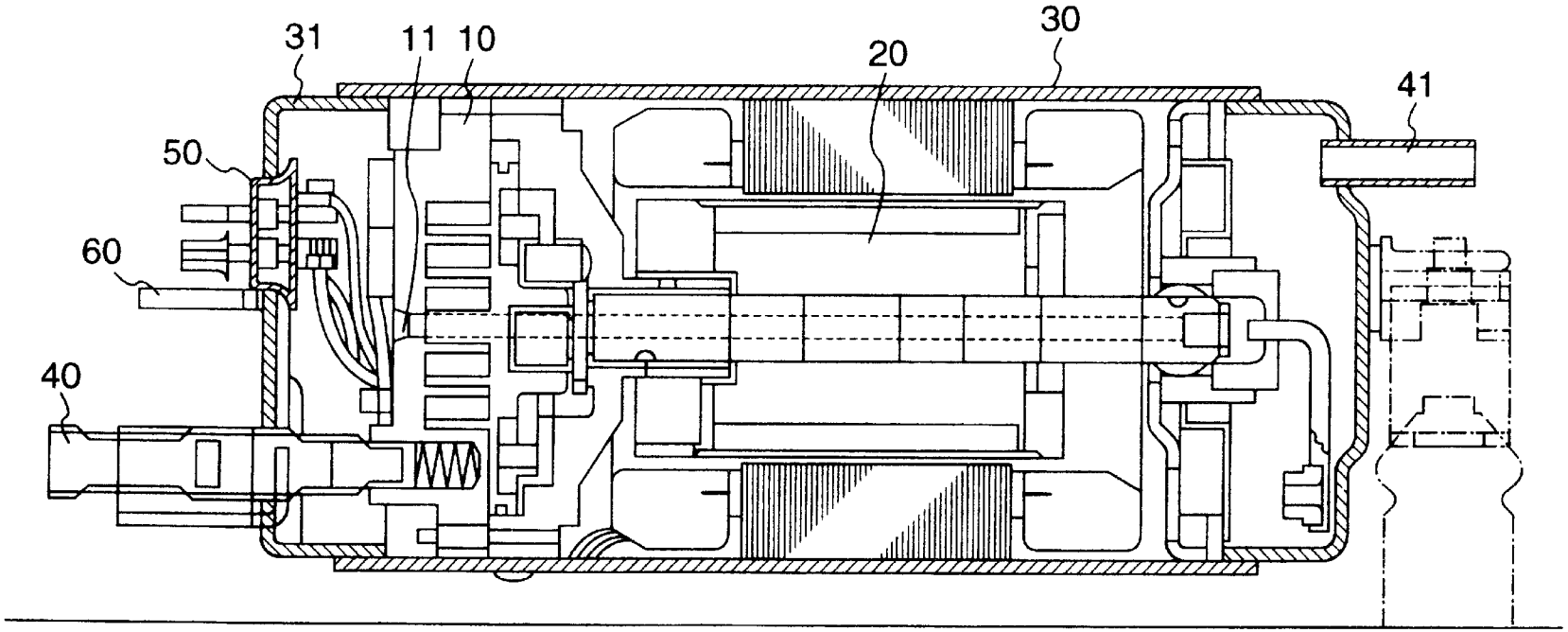
FIG. 4 is a cross sectional view showing a structure of a prior closed-type electrically-driven compressor.

In the closed-type electrically-driven compressor, in which a compressing mechanism portion 10 and an electric motor portion 20 driving the compressing mechanism portion are received within a cylindrical body 30 which constitutes a main body of a closed container shown in FIG. 4, a refrigerant sucked from a refrigerant suction pipe 40 is compressed in the compressing mechanism portion 10 to be discharged into the cylindrical body 30 from a refrigerant discharge port 11 provided in the compressing mechanism portion 10 to be filled into the cylindrical body 30 to be further discharged from a discharge pipe 41. Accordingly, the refrigerant exerts internal pressures in the closed container in operation.

Here, description will be given to the case where the conventional cover body compatible with refrigerant R-22 and having an allowable withstand pressure is subjected to an internal pressure of about 43 kgf/cm$^2$ which is about 1.5 times the conventional pressure and is for a refrigerant R-410A.

Figure 5:
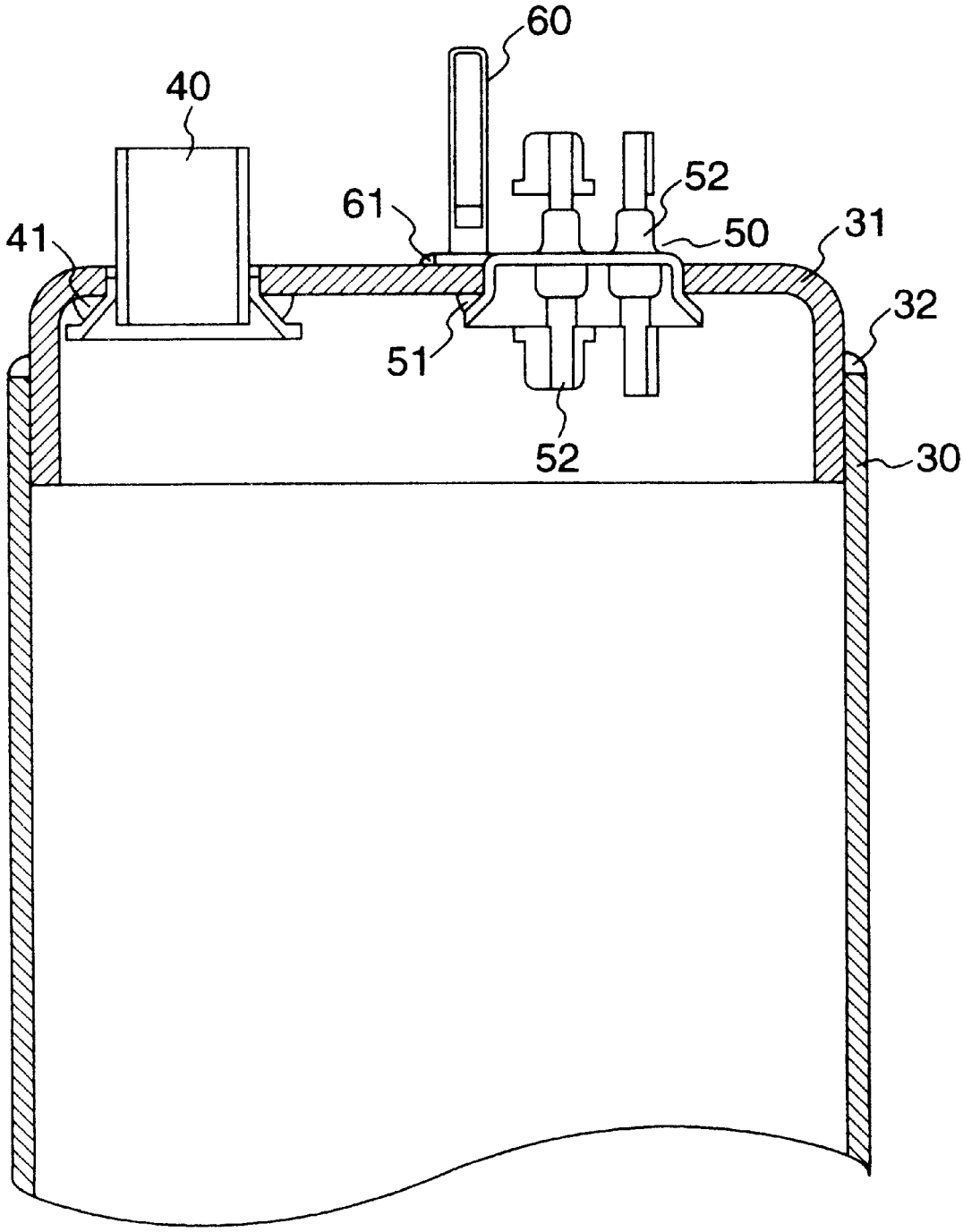
FIG. 5 is a cross sectional view showing an essential part including a cylindrical body and a cover body in prior closed-type electrically-driven compressor.

The conventional cover body 31 shown in FIG. 5 is formed by press work on a steel sheet, and is constructed such that fix the terminal 50 for supplying electricity to the electric motor portion and the suction pipe 40 for a refrigerant are fixed by welding.

Figure 6:
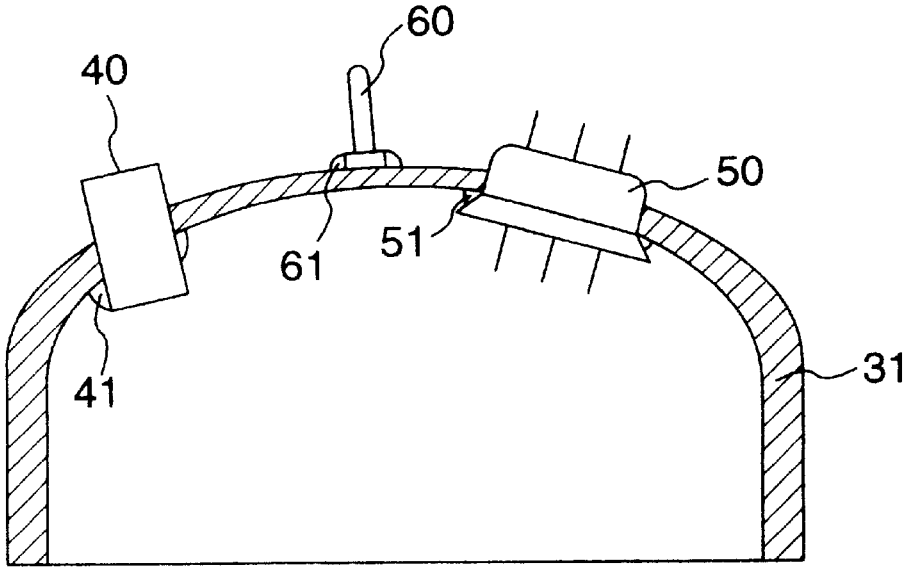
FIG. 6 is a cross sectional view showing an essential part of the prior closed-type electrically-driven compressor with the cover body deformed due to an internal pressure.

The cover body 31 having been substantially flat before pressurization deforms as internal pressures apply such that a center of the cover body 31 is made a concavely curved surface as illustrated in FIG. 6. At this time, since there is a tendency that the central portion of the cover body 31 deforms more than and hence is made thinner than the peripheral portion thereof, and the terminal 50 is smaller in pressure bearing area than the cover body and so has a higher rigidity than that of the cover body, stress concentration generates at a welded portion near the center of the cover body, thus leading to reduction in reliability.

In order to solve the problem, it can be contemplated to increase a thickness of the cover plate. However, in order to withstand pressure increase of an about 1.5 times as described above, it is necessary to set a thickness of the cover body 31 to be about 2.5 times that of the conventional one, which causes problems that the cover body can not be easily formed by press work of steel sheet, and that the cover body is increased in weight and a production cost is increased.

Then, an embodiment of the cover body will be described hereinbelow which ensures pressure withstand without being significantly increased in thickness and solves a problem with respect to assembling quality such as weldability between the cover body and the terminal and between the cover body and the refrigerant circulating pipe.

A first embodiment of the invention will be described hereinbelow with reference to FIG. 1.

Figure 1:
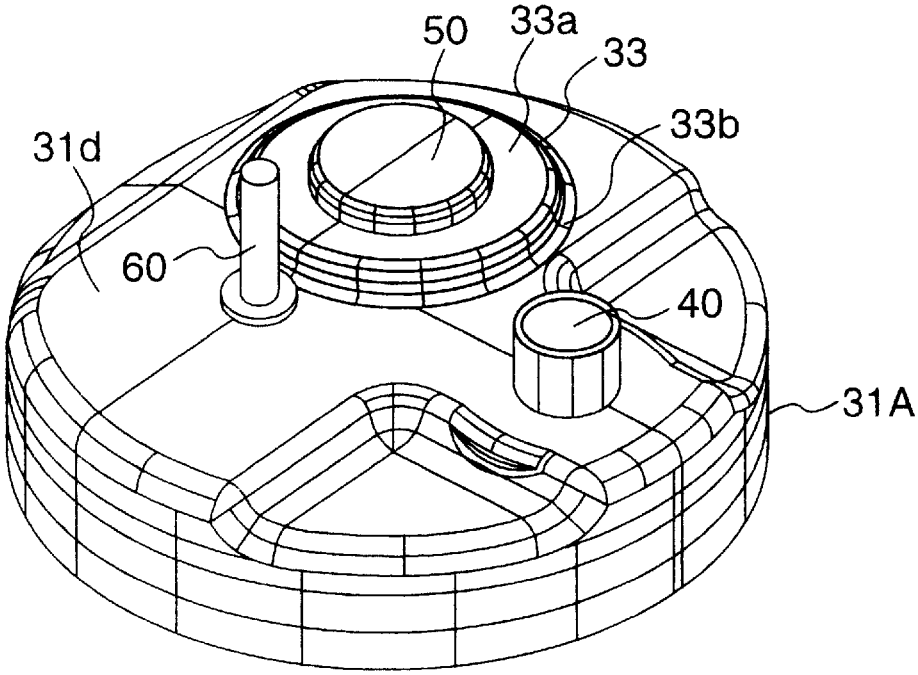
FIG. 1 is a perspective view showing a cover body of a closed-type electrically-driven compressor according to a first embodiment of the present invention.

FIG. 1 is a perspective view showing a cover body of a closed-type electrically-driven compressor according to a first embodiment of the invention. In FIG. 1, the same reference numerals as those in FIG. 5 denote the same elements as those of the cover body of the prior art.

Being a perspective view of the cover body, FIG. 1 corresponds to a mesh division drawing in a stress analysis of the present embodiment and lines in the drawing indicate model lines obtained by dividing the mesh. In addition, FIGS. 2 and 3 described later similarly correspond to mesh division drawings.

The cover body 31A shown in FIG. 1 is formed by press work on a metal sheet. A convex-shaped portion 33 is formed in concentric manner around the terminal 50 on the cover body, which had been conventionally substantially flat, in such a manner as to be protuberant above a peripheral flat portion 31*d* of the cover body 31A. The convex-shaped portion 33 comprises a drawn-shaped portion having a flat portion 33*a* which is protuberant above the peripheral flat portion 31*d* of the cover body 31A and is separated from the flat portion 31*d*, and a smooth stepped portion 33*b*. The drawn-shaped portion functions as a rib.

Formation of the convex-shaped portion 33 in concentric manner to be protuberant above the peripheral flat portion 31*d* of the cover body leads to division of the peripheral flat portion of the terminal 50 by the flat portion 33*a* of the convex-shaped portion 33 and hence division of the pressure receiving area. Accordingly, the stress concentration, which had been conventionally generated around the peripheral portion of the terminal 50, can be relaxed. As a result of such change in configuration, an amount of strain can be reduced to 10% or less of the conventional amount, and an amount of deformation of the cover body 31A can be significantly restricted.

Next, a second embodiment of the invention will be described hereinbelow with reference to FIG. 2.

Figure 2:
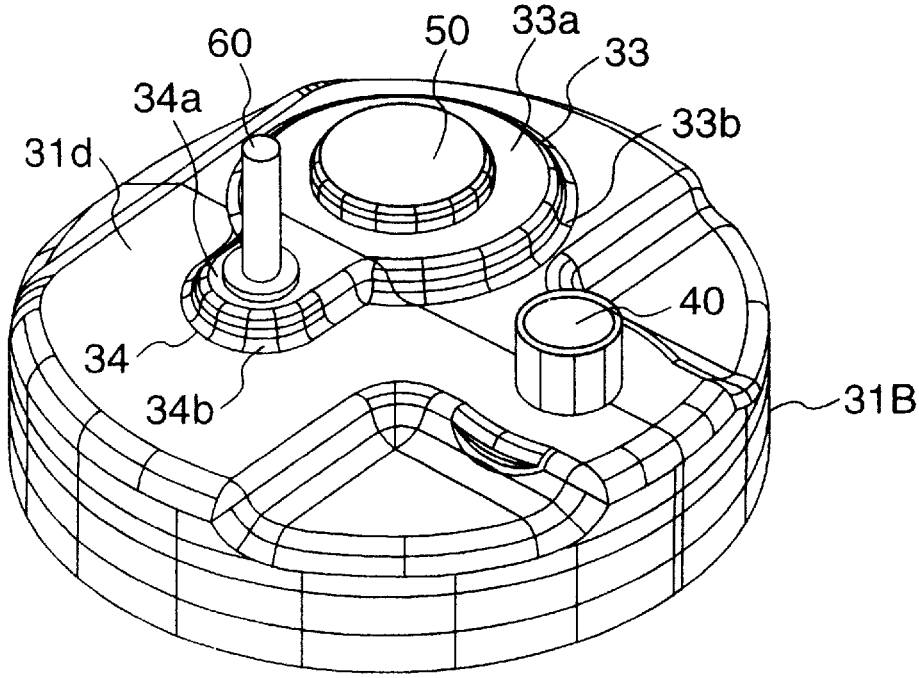
FIG. 2 is a perspective view showing a cover body of a closed-type electrically-driven compressor according to a second embodiment of the present invention.

FIG. 2 is a perspective view showing a cover body of the closed-type electrically-driven compressor according to a second embodiment of the present invention. In FIG. 2, the same reference numerals as those in FIG. 5 denote the same elements as those of the cover body in the prior art and the same reference numerals as those in FIG. 1 denote the same elements as those of the first embodiment.

A cover body 31B shown in FIG. 2 is constructed such that a convex-shaped portion 34 is formed in concentric manner around a pin 60, for fixing a cover covering the terminal 50, as well as the convex-shaped portion 33 formed in concentric manner around the terminal 50 and being protuberant above the peripheral flat portion 31*d* of the cover body 31B.

The convex-shaped portion 33 around the terminal and the convex-shaped portion 34 around the pin 60, respectively, have drawn-shaped portions which are protuberant above the peripheral flat portion 31*d* of the cover body 31B and have the flat portions 33*a* and 34*a* separated from the flat portion 31*d*, and the smooth stepped portions 33*b* and 34*a*. The flat portions 33*a* and 34*a* of the convex-shaped portions 33 and 34 are substantially formed to be at the same level.

Like the first embodiment, formation of the convex-shaped portions leads not only to reduction in stress concentration in the peripheral portion of the terminal 50, but also to further restriction of deformation of the entire cover body 31B. As a result, the cover body 31 can be prevented from expanding into a spherical configuration as in the prior art illustrated in FIG. 6. Accordingly, as shown in FIG. 6, close adherence of the cover, which covers the terminal 50, to the cover body can be suppressed from being adversely affected by inclination of a direction in the suction pipe 40 and inclination of the pin 60.

Next, a third embodiment of the invention will be described hereinbelow with reference to FIG. 3.

Figure 3:
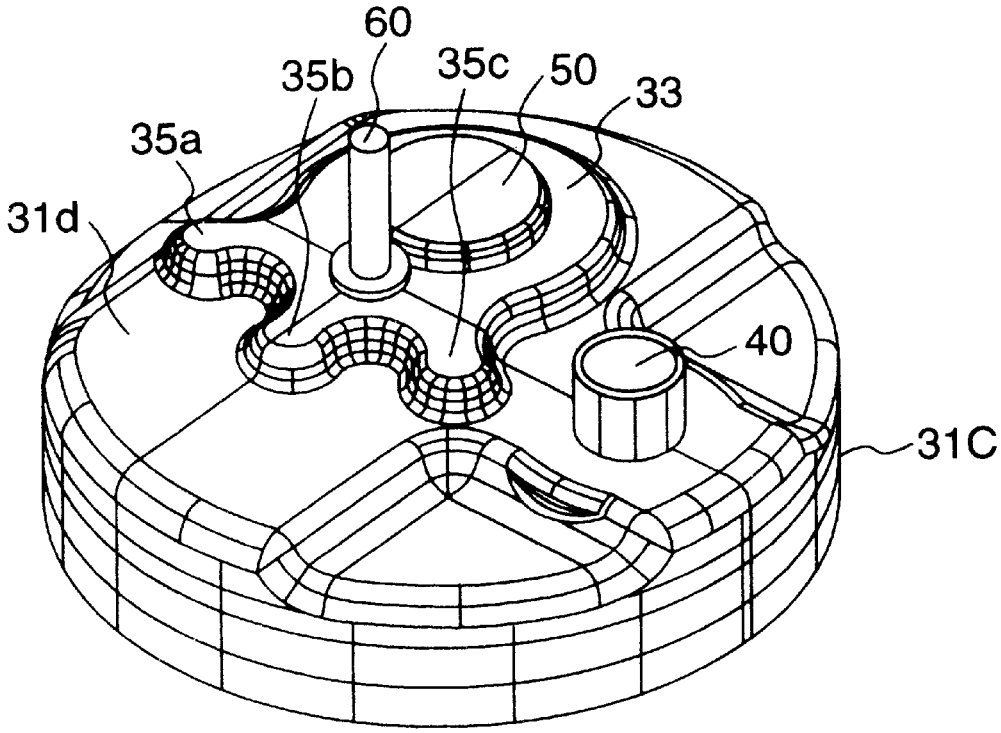
FIG. 3 is a perspective view showing a cover body of a closed-type electrically-driven compressor according to a third embodiment of the present invention.

FIG. 3 is a perspective view showing a cover body of the closed-type electrically-driven compressor according to a third embodiment of the present invention. In FIG. 3, the same reference numerals as those in FIG. 5 denote the same elements as those of the cover body in the prior art and the same reference numerals as those in FIG. 1 denote the same elements as those of the first embodiment, so that description thereof will be omitted.

A cover body 31C shown in FIG. 3 is constructed such that the convex-shaped portion 33 is formed in concentric manner around the terminal 50 to be protuberant above the peripheral flat portion 31*d* of the cover body and a plurality of convex-shaped portions 35*a*, 35*b* and 35*c* radially extending in a radial direction (in this embodiment, in three directions) of the terminal 50 as well as the convex-shaped portion around the pin 60 are formed. The convex-shaped portion 35*a*, 35*b* and 35*c*, respectively, comprises a drawn-shaped portion having a flat portion which radially extends in a radial direction of the terminal 50 to be protuberant above the peripheral flat portion 31*d* and separated from the flat portion 31*d*, and a smooth stepped portion. These convex-shaped portions 33*a*, 35*a*, 35*b* and 35*c* are formed to be substantially at the same level.

In the embodiment shown in FIG. 3, since the pressure bearing area of the cover body 31C can be separated into more sections than those in the second embodiment, the cover body 31C can be further restricted in deformation.

In addition, while the drawn-shaped portion is formed in convex form in the respective embodiments mentioned above, it may be formed in concave form to produce similar results to those with the convex form and can further restrict a length of the closed container as compared with the convex form.

As mentioned above, not a spherical surface but a flat surface is ensured on the cover body, so that it is possible to provide a light and compact closed-type electrically-driven compressor which can ensure adequate strength for the connections in the terminal 50 and the refrigerant circulating pump pipe 40 and restrict the material thickness to the minimum.

In accordance with the respective embodiments mentioned above, provision of a concave-shaped or convex-shaped portion partly on a substantially flat cover body of the prior art in a closed-type electrically-driven compressor, which uses an alternative refrigerant such as a refrigerant R-410A and the like, restricts an increase in thickness of the cover body as much as possible, and solves problems of cracks and leakage of refrigerant in the welded portions between the cover body and the terminal or between the cover body and the refrigerant suction pipe, so that there can be provided a closed-type compressor which realizes a pressure withstand capable of withstanding a high pressure refrigerant such as a refrigerant R-410A and the like, has a favorable part mounting quality and a part assembling quality, and is provided with a lightweight, inexpensive and reliable cover body.

As specifically described above, in accordance with the present invention, it is possible to provide a closed-type electrically-driven compressor which uses an alternative refrigerant typified by a refrigerant R-410A, and can restrict an increase of the thickness of the cover body as much as possible, ensure a withstand pressure, and improve an assembling quality such as weldability between the cover body and the terminal, and between the cover body and the refrigerant circulating pipe.

What is claimed is:

1. A closed-type electrically-driven compressor comprising a substantially cylindrical closed container having a cover body, a compressing mechanism portion and an electric motor portion driving said compressing mechanism portion within said closed container, said compressing mechanism portion having a discharge port for discharging a compressed refrigerant into said closed container, said closed container having a discharge pipe for discharging the compressed refrigerant from said closed container, and a terminal fitted into a hole formed in a cover body of said closed container and welded to the cover body, and wherein said cover body has a flat portion and wherein a mount portion and vicinities of said terminal on the cover body of said closed container are formed to be either concave or convex from the flat portion of said cover body.

2. A closed-type electrically-driven compressor comprising a substantially cylindrical closed container having a cover body, a compressing mechanism portion and an electric motor portion driving said compressing mechanism portion within said closed container, said compressing mechanism portion having a discharge port for discharging a compressed refrigerant into said closed container, said closed container having a discharge pipe for discharging the compressed refrigerant from said closed container, a terminal fitted into a hole formed in a cover body of said closed container and welded to cover the body of said closed container and welded to the cover body, and a drawn-shaped portion formed in a mount portion of said terminal on the cover body on said closed container and having a flat portion which is substantially concentric about said mount portion of said terminal to be protuberant above and separated from a peripheral flat portion of said cover.

3. A closed-type electrically-driven compressor comprising a substantially cylindrical closed container having a cover body, a compressing mechanism portion and an electric motor portion driving said compressing mechanism portion within said closed container, said compressing mechanism portion having a discharge port for discharging a compressed refrigerant into said closed container, said closed container having a discharge pipe for discharging the compressed refrigerant from said closed container, and a terminal fitted into a hole formed in a cover body of said closed container and welded to the cover body, and wherein said cover body has a flat portion and wherein a mount portion and vicinities of said terminal on the cover body of said closed container are formed to be either concave or convex from the flat portion of said cover body and wherein a portion radially of said terminal is formed in either of concave and convex shapes.

* * * * *